US009321276B2

(12) United States Patent
Hamada et al.

(10) Patent No.: US 9,321,276 B2
(45) Date of Patent: Apr. 26, 2016

(54) DECORATING METHOD, CONTROL APPARATUS, AND DECORATING SYSTEM

(71) Applicant: SEIREN CO., LTD., Fukui (JP)

(72) Inventors: Takehiko Hamada, Fukui (JP); Manabu Tsuda, Fukui (JP)

(73) Assignee: SEIREN CO., LTD., Fukui (JP)

( * ) Notice: Subject to any disclaimer, the term of this patent is extended or adjusted under 35 U.S.C. 154(b) by 0 days.

(21) Appl. No.: 14/397,776

(22) PCT Filed: Apr. 18, 2013

(86) PCT No.: PCT/JP2013/061534
§ 371 (c)(1),
(2) Date: Oct. 29, 2014

(87) PCT Pub. No.: WO2013/164953
PCT Pub. Date: Nov. 7, 2013

(65) Prior Publication Data

US 2015/0085005 A1 Mar. 26, 2015

(30) Foreign Application Priority Data

May 2, 2012 (JP) ..... 2012-105499

(51) Int. Cl.
*B41J 29/38* (2006.01)
*B41J 2/21* (2006.01)
(Continued)

(52) U.S. Cl.
CPC *B41J 2/21* (2013.01); *B41J 3/4078* (2013.01); *D06P 5/30* (2013.01)

(58) Field of Classification Search
CPC .. B41J 2/04541; B41J 2/0458; B41J 2/04581; B41J 3/4078
USPC ..... 347/9
See application file for complete search history.

(56) References Cited

U.S. PATENT DOCUMENTS 6,027,200 A 2/2000 Takahashi
6,220,687 B1 4/2001 Takahashi
(Continued)

FOREIGN PATENT DOCUMENTS

CN 1094528 A 11/1994
EP 0613288 A2 8/1994
(Continued)

OTHER PUBLICATIONS

Seiren Co., Ltd., "What's Viscotecs?", http://www.viscotecs.com/english/about/index.html (searched on Feb. 3, 2012); English translation thereof.
(Continued)

*Primary Examiner* — Jannelle M Lebron
*Assistant Examiner* — Jeremy Bishop
(74) *Attorney, Agent, or Firm* — Rankin, Hill & Clark LLP

(57) ABSTRACT

Pattern information for identifying a pattern and color information for identifying a color are acquired. Image data corresponding to the acquired pattern information and color information is acquired from a storage unit configured to store at least two types of image data out of first to fourth image data. The first image data corresponds to first pattern information for identifying a first pattern and first color information for identifying a first color. The second image data corresponds to the first pattern information and second color information for identifying a second color. The third image data corresponds to second pattern information for identifying a second pattern and the first color information. The fourth image data corresponds to the second pattern information and the second color information. A colored pattern corresponding to the acquired image data is recorded onto a base material.

15 Claims, 3 Drawing Sheets

| No. | PATTERN INFORMATION | COLOR INFORMATION | IMAGE DATA INFORMATION |
|---|---|---|---|
| 1 | PPP | BLK | image_A |
| 2 | PPP | RED | image_B |
| 3 | PPP | BLU | image_C |
| 4 | PPP | YEL | image_D |
| 5 | QQQ | BLK | image_E |
| 6 | QQQ | RED | image_F |
| 7 | QQQ | BLU | image_G |
| 8 | QQQ | YEL | image_H |
| 9 | RRR | BLK | image_I |
| 10 | RRR | RED | image_J |
| 11 | RRR | BLU | image_K |
| 12 | RRR | YEL | image_L |

(51) Int. Cl.
*D06P 5/30* (2006.01)
*B41J 3/407* (2006.01)

(56) References Cited

U.S. PATENT DOCUMENTS

| | | | | |
|---|---|---|---|---|
| 6,243,110 | B1 | 6/2001 | Takahashi | |
| 6,588,879 | B2 * | 7/2003 | Kushner | H04N 1/54 347/15 |
| 7,139,096 | B2 * | 11/2006 | Ishikawa | H04N 1/52 347/15 |
| 7,394,555 | B2 * | 7/2008 | Cox | B41J 3/4078 347/20 |
| 2006/0279773 | A1 * | 12/2006 | Sakurai et al. | 358/1.15 |
| 2010/0157357 | A1 * | 6/2010 | Torikoshi | G06F 3/1203 358/1.15 |
| 2012/0281243 | A1 * | 11/2012 | Yanai | G06K 15/107 358/1.8 |

FOREIGN PATENT DOCUMENTS

| | | | |
|---|---|---|---|
| EP | 0987878 | A1 | 3/2000 |
| JP | 2939908 | | 6/1999 |
| JP | 2001-229228 | | 8/2001 |
| JP | 2002-038382 | | 2/2002 |
| JP | 2002-127556 | | 5/2002 |
| JP | 2004-220063 | | 8/2004 |
| JP | 2007-100255 | | 4/2007 |

OTHER PUBLICATIONS

International Search Report dated Jul. 16, 2013 filed in PCT/JP2013/061534.

Cited in Chinese Office Action issued on Oct. 8, 2015 for the corresponding Chinese Patent Application No. 201380022749.X and English translation thereof.

* cited by examiner

FIG. 2

| BASE MATERIAL | PATTERN | COLOR | |
|---|---|---|---|
| BASE MATERIAL X | PATTERN P | BLACK | FIRST SAMPLE LIST |
| | | RED | |
| | | BLUE | |
| | | YELLOW | |
| BASE MATERIAL Y | PATTERN Q | BLACK | SECOND SAMPLE LIST |
| | | RED | |
| | | BLUE | |
| | | YELLOW | |
| BASE MATERIAL Y | PATTERN R | BLACK | THIRD SAMPLE LIST |
| | | RED | |
| | | BLUE | |
| | | YELLOW | |

| No. | PATTERN INFORMATION | COLOR INFORMATION | IMAGE DATA INFORMATION |
|---|---|---|---|
| 1 | PPP | BLK | image_A |
| 2 | PPP | RED | image_B |
| 3 | PPP | BLU | image_C |
| 4 | PPP | YEL | image_D |
| 5 | QQQ | BLK | image_E |
| 6 | QQQ | RED | image_F |
| 7 | QQQ | BLU | image_G |
| 8 | QQQ | YEL | image_H |
| 9 | RRR | BLK | image_I |
| 10 | RRR | RED | image_J |
| 11 | RRR | BLU | image_K |
| 12 | RRR | YEL | image_L |

DECORATING METHOD, CONTROL APPARATUS, AND DECORATING SYSTEM

TECHNICAL FIELD

The present invention relates to a decorating method for recording a predetermined colored pattern onto a base material by an inkjet recording apparatus to manufacture a cloth decorated by the predetermined colored pattern, a control apparatus configured to control the inkjet recording apparatus, and a decorating system.

BACKGROUND ART

Coloring methods by a printing, a yarn dyeing, and so on are known as a method for applying a pattern onto a base material to make a decorated cloth. Besides this, a method of rendering a pattern by the structure of weave and knit such as a jacquard method, and a method of a partial solution or contraction in a patterned manner by a chemical process are known. Further, a method of applying a partial heat treatment in a patterned manner by an engraved thermal roll and the like to provide distortion of the structure, and the like are known.

For the art regarding the decorated cloth, Patent Literature 1 discloses a manufacturing method of a fiber cloth having a discretionary three-dimensional pattern or openwork pattern. In this manufacturing method of the fiber cloth, a composition containing a foaming agent and a water-soluble binder are applied onto at least one side of the fiber cloth base material containing thermoplastic fiber. Then, foaming by a heat treatment is performed. Next, a cleaning process is applied. Patent Literature 1 also discloses that a jacquard weave, an emboss machining, and an opal machining and so on are known for the method for applying a three-dimensional patterning to the cloth.

In Patent Literature 2, the Applicant has proposed the art regarding the method of rendering the three-dimensional pattern on a dress material. The Applicant has developed and implemented the system called as Viscotecs™ disclosed in Non-patent Literature 1.

CITATION LIST

Patent Literatures

PATENT LITERATURE 1: JP-A-2007-100255
PATENT LITERATURE 2: Japanese Patent No. 2939908

Non-Patent Literature

NON-PATENT LITERATURE 1: SEIREN CO., LTD. "What is Viscotecs™"[online], [searched on Feb. 3, 2012], Internet <http://www.viscotecs.com/about/>

SUMMARY OF INVENTION

Problems to be Solved by the Invention

In a method of forming a pattern by a weave and knit structure, a special device allowing for the pattern forming by the structure is required to be incorporated in a weaving machine or a knitting machine or installed thereto as an attachment device. Furthermore, the composition of the pattern depends on the performance of the apparatus that forms the pattern. Thus, the method of forming the pattern by the weave and knit structure may be restrictive.

When the pattern is formed by a chemical process, reduction in the strength may occur at the cloth itself though partially, which may cause an unstable quality. Therefore, an additional countermeasure against it may be required. When the pattern is formed by the partial heat treatment by a heat roll, it is necessary to make an expensive roll that is engraved according to the pattern. In addition, it is necessary to heat this roll to a high temperature and control the variation in the temperature. For example, in the case of a polyester-based fiber cloth, the roll is heated at approximately 150 to 195 degrees centigrade. Furthermore, in the method by the chemical process and the heat roll, typically, the reduction in the strength of the cloth may be more likely to occur when a further vivid pattern is intended to be obtained.

The present invention intends to provide a decorating method, a control apparatus, and a decorating system capable of using an inkjet recording apparatus to preferably manufacture a cloth decorated with a predetermined colored pattern, which is to be a material for forming a predetermined cloth product.

Solutions to the Problems

An aspect of the present invention is a decorating method for recording a predetermined colored pattern onto a base material set at an inkjet recording apparatus to manufacture a cloth decorated with the predetermined colored pattern, and the decorating method includes: a first step of acquiring pattern information for identifying a pattern and color information for identifying a color; a second step of acquiring image data corresponding to the pattern information and the color information acquired at the first step, from a storage unit configured to store at least two types of image data out of first image data corresponding to first pattern information for identifying a first pattern and first color information for identifying a first color, second image data corresponding to the first pattern information and second color information for identifying a second color, third image data corresponding to second pattern information for identifying a second pattern and the first color information, and fourth image data corresponding to the second pattern information and the second color information; and a third step of recording, onto the base material, a colored pattern corresponding to the image data acquired at the second step.

According to this decorating method, a desired colored pattern is recorded onto the base material by storing a plurality of image data having the different combinations of the pattern and the color, and obtaining image data that corresponds to the desired colored pattern out of these. This allows for preferable manufacturing of the decorated cloth. Generating and storing in advance a plurality of image data can facilitate a smooth start of the recording of the predetermined colored pattern. This allows for a short delivery, for example, in the actual market. In the cloth manufactured in this way, unlike a woven fabric or a knitted fabric in which the pattern is formed by the weave and knit structure, the predetermined colored pattern is recorded onto the base material. The inkjet recording apparatus allows for a high quality recording. Therefore, a user viewing the cloth is able to give the same impression as or a similar impression to the case of viewing the colored pattern rendered by dyeing of the woven fabric or the knitted fabric where the pattern is formed by the weave and knit structure.

The "acquiring image data corresponding to the pattern information and the color information acquired at the first step" in the second step can be construed as follows. Specifically, when the first pattern information is acquired as the pattern information and the first color information is acquired as the color information at the first step, the first image data is acquired at the second step. In this case, in the third step, the first pattern in the first color corresponding to the first image data is recorded onto the base material. When the first pattern information is acquired as the pattern information and the second color information is acquired as the color information at the first step, the second image data is acquired at the second step. In this case, in the third step, the first pattern in the second color corresponding to the second image data is recorded onto the base material. When the second pattern information is acquired as the pattern information and the first color information is acquired as the color information at the first step, the third image data is acquired at the second step. In this case, in the third step, the second pattern in the first color corresponding to the third image data is recorded onto the base material. When the second pattern information is acquired as the pattern information and the second color information is acquired as the color information at the first step, the fourth image data is acquired at the second step. In this case, in the third step, the second pattern in the second color corresponding to the fourth image data is recorded onto the base material.

In this decorating method, the first image data and the second image data may be associated with a first base material, the third image data and the fourth image data may be associated with a second base material. In the third step, when the first image data or the second image data is acquired at the second step, a colored pattern corresponding to the image data acquired at the second step may be recorded onto the first base material, and when the third image data or the fourth image data is acquired at the second step, a colored pattern corresponding to the image data acquired at the second step may be recorded onto the second base material.

This allows for the decorating method applicable to a plurality of types of base materials. Therefore, the colored pattern corresponding to the first image data or the second image data is recorded onto the first base material and thereby the decorated cloth can be manufactured. The colored pattern corresponding to the third image data or the fourth image data is recorded onto the second base material and thereby the decorated cloth can be manufactured.

Another aspect of the present invention is a control apparatus that, when manufacturing a cloth decorated with a predetermined colored pattern, controls an inkjet recording apparatus configured to record the predetermined colored pattern onto a base material, and the control apparatus includes: a first acquisition unit configured to acquire pattern information for identifying a pattern and color information for identifying a color inputted to the control apparatus; a second acquisition unit configured to acquire image data corresponding to the pattern information and the color information acquired by the first acquisition unit, from a storage unit configured to store at least two types of image data out of first image data corresponding to first pattern information for identifying a first pattern and first color information for identifying a first color, second image data corresponding to the first pattern information and second color information for identifying a second color, third image data corresponding to second pattern information for identifying a second pattern and the first color information, and fourth image data corresponding to the second pattern information and the second color information; and a recording control unit configured to perform a control of recording, by the inkjet recording apparatus, onto the base material, a colored pattern corresponding to the image data acquired by the second acquisition unit. This control apparatus allows for implementing the above-described decorating method. This control apparatus is able to provide the function allowed by the above-described decorating method.

Still another aspect is a decorating system that manufactures a cloth decorated with a predetermined colored pattern, and the decorating system includes: an inkjet recording apparatus configured to record the predetermined colored pattern onto a base material; a control apparatus configured to control the inkjet recording apparatus; and a storage unit configured to store at least two types of image data out of first image data corresponding to first pattern information for identifying a first pattern and first color information for identifying a first color, second image data corresponding to the first pattern information and second color information for identifying a second color, third image data corresponding to second pattern information for identifying a second pattern and the first color information, and fourth image data corresponding to the second pattern information and the second color information. The control apparatus includes: a first acquisition unit configured to acquire pattern information for identifying a pattern and color information for identifying a color inputted to the control apparatus; a second acquisition unit configured to acquire image data corresponding to the pattern information and the color information acquired by the first acquisition unit, from the storage unit; and a recording control unit configured to perform a control of recording, by the inkjet recording apparatus, onto the base material, a colored pattern corresponding to the image data acquired by the second acquisition unit. This decorating system allows for implementing the above-described decorating method. This decorating system is able to provide the function allowed by the above-described decorating method.

The "acquire image data corresponding to the pattern information and the color information acquired by the first acquisition unit" in the second acquisition unit that is included in the control apparatus and the control apparatus in the decorating system described above, respectively, can be construed as follows. Specifically, when the first pattern information is acquired as the pattern information and the first color information is acquired as the color information by the first acquisition unit, the first image data is acquired by the second acquisition unit. In this case, in the recording control unit, the first pattern in the first color corresponding to the first image data is recorded onto the base material. When the first pattern information is acquired as the pattern information and the second color information is acquired as the color information by the first acquisition unit, the second image data is acquired by the second acquisition unit. In this case, in the recording control unit, the first pattern in the second color corresponding to the second image data is recorded onto the base material. When the second pattern information is acquired as the pattern information and the first color information is acquired as the color information by the first acquisition unit, the third image data is acquired by the second acquisition unit. In this case, in the recording control unit, the second pattern in the first color corresponding to the third image data is recorded onto the base material. When the second pattern information is acquired as the pattern information and the second color information is acquired as the color information by the first acquisition unit, the fourth image data is acquired by the second acquisition unit. In this case, in the recording control unit, the second pattern in the second color corresponding to the fourth image data is recorded onto the base material.

In the control apparatus and the control apparatus in the decorating system as described above, the storage unit may be either integrated to or separated from the control apparatus.

When the control apparatus and the storage unit are integrated, the control apparatus incorporates the storage unit therein. When the control apparatus and the storage unit are separated, the control apparatus and the storage unit are connected so as to be able to communicate data.

Advantageous Effects of the Invention

The present invention allows for obtaining a decorating method, a control apparatus, and a decorating system capable of using an inkjet recording apparatus to preferably manufacture a cloth decorated with a predetermined colored pattern, which is to be a material for forming a predetermined cloth product.

BRIEF DESCRIPTION OF THE DRAWINGS

FIG. 2 is a diagram illustrating sample lists.

DESCRIPTION OF EMBODIMENTS

Embodiments for implementing the present invention will be described by using the drawings. The present invention is not limited to the following configuration, and various configurations in the same technical idea can be employed. For example, a part of the following configuration may be omitted or replaced with other configuration and the like. Other configuration may be provided.

<Decorating System>

Figure 1:
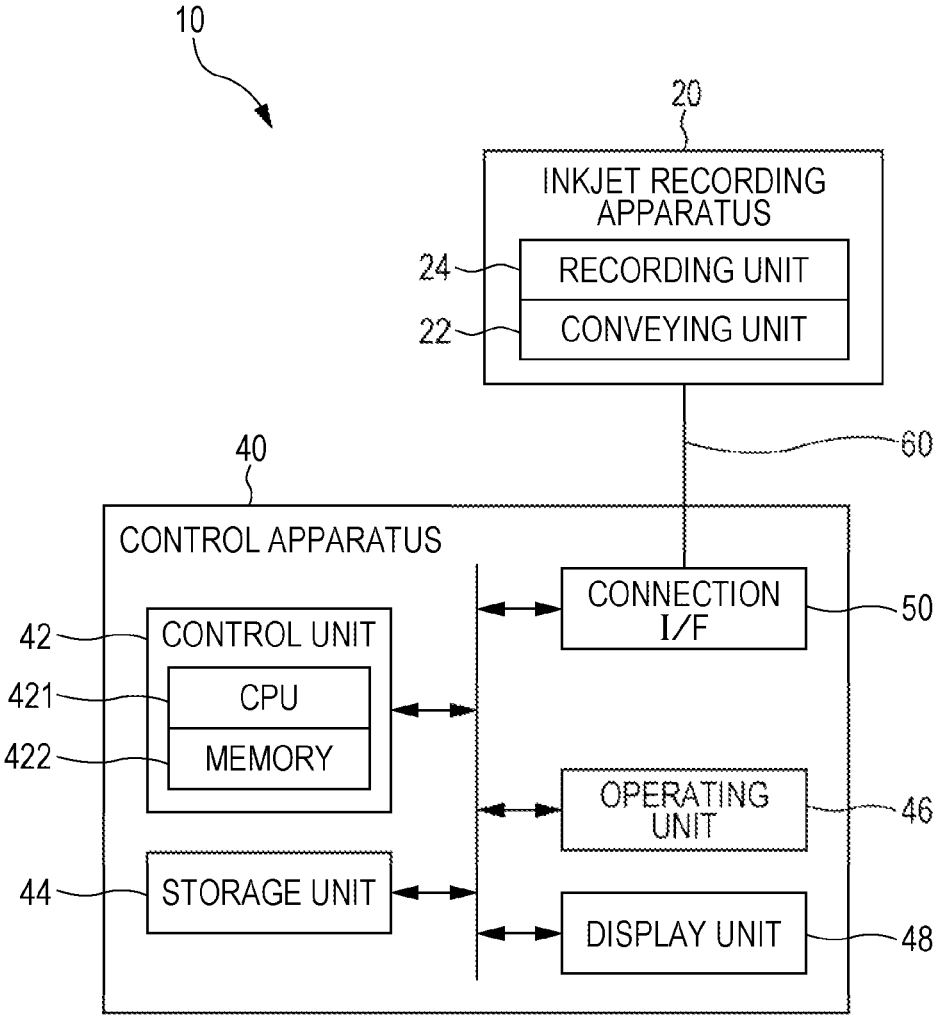
FIG. 1 is a block diagram illustrating an example of a decorating system.

A decorating system 10 will be described by referring to FIG. 1 to FIG. 3. The decorating system 10 includes an inkjet recording apparatus 20 and a control apparatus 40 as illustrated in FIG. 1. The inkjet recording apparatus 20 and the control apparatus 40 are connected via a communication cable 60. The inkjet recording apparatus 20 communicates with the control apparatus 40 via the communication cable 60. In the decorating system 10, out of the plurality of predefined designs having the elements of base materials, patterns, and colors, a predetermined colored pattern is recorded onto a predetermined base material, and the cloth decorated with this predetermined colored pattern is manufactured. For the patterns, any patterns may be employed in addition to the well-known patterns (designs). The patterns that can be recognized to be three-dimensional may also be employed. The base material is a cloth material such as a woven cloth or a knitted cloth. The surface of the base material is in a flat state having no (or little) unevenness. The material of fiber forming the base material is not limited in particular. The inkjet recording apparatus 20 records the predetermined colored pattern onto the base material. The control apparatus 40 controls the inkjet recording apparatus 20. The cloth decorated with the predetermined colored pattern manufactured in the decorating system 10 is to be a material for forming a cloth product such as a dress.

The decorating system 10 is implemented as follows. A supplier who manages the decorating system 10 and supplies the cloth decorated with the predetermined colored pattern makes sample lists. The sample lists are lists associating the base material, the pattern, and the color, for example. The supplier makes first to third sample lists having such sets as illustrated in FIG. 2. The first sample list includes a cloth obtained by recording a black pattern P onto a base material X, a cloth obtained by recording a red pattern P onto the base material X, a cloth obtained by recording a blue pattern P onto the base material X, and a cloth obtained by recording a yellow pattern P onto the base material X, as samples. The second sample list includes a cloth obtained by recording a black pattern Q onto a base material Y, a cloth obtained by recording a red pattern Q onto the base material Y, a cloth obtained by recording a blue pattern Q onto the base material Y, and a cloth obtained by recording a yellow pattern Q onto the base material Y as samples. The third sample list includes a cloth obtained by recording a black pattern R onto the base material Y, a cloth obtained by recording a red pattern R onto the base material Y, a cloth obtained by recording a blue pattern R onto the base material Y, and a cloth obtained by recording a yellow pattern R onto the base material Y, as samples. While each of the first to third sample lists illustrated in FIG. 2 includes four colors of black, red, blue, and yellow, the color and/or the number of colors may be different for respective sample lists. Preferably, the number of sample lists (the number of patterns and/or the number of base materials) to be made is also properly set. While the base materials include the base material X (the first sample list) and the base material Y (the second and third sample lists), the type of the base material may be different among respective sample lists. All the base materials may be of the same type.

The supplier provides the made sample lists, which are the first to third sample lists when based on the example of FIG. 2, to a manufacturer (hereafter, referred to as "consumer") of the cloth product such as a dress using the cloth decorated with the predetermined colored pattern as a material. The consumer selects a pattern and a color for the cloth to be used in the manufacturing of the cloth product out of a plurality of designs (twelve in total: three (the number of patterns) by four (the number of colors)) defined in the first sample list to the third sample list. The consumer then informs the supplier of the selected pattern and color by a predetermined way. According to the information from the consumer, the supplier records a predetermined colored pattern that meets the request by the consumer onto the corresponding type of the base material (see FIG. 2).

For example, when the request by the consumer is the pattern P and the color red, the supplier uses the decorating system 10 to record the red pattern P onto the base material X and manufactures the cloth recorded with the red pattern P. When the request by the consumer is the pattern Q and the color blue, the supplier uses the decorating system 10 to record the blue pattern Q onto the base material Y and manufactures the cloth recorded with the blue pattern Q. When the request by the consumer is the pattern R and the color yellow, the supplier uses the decorating system 10 to record the yellow pattern R onto the base material Y and manufactures the cloth recorded with the yellow pattern R. The manufactured cloth is provided to the consumer.

For the inkjet recording apparatus 20, the same inkjet recording apparatus as those that have already been put into use can be employed. The inkjet recording apparatus 20 has a conveying unit 22 and a recording unit 24, for example. The conveying unit 22 conveys the base material. The recording unit 24 has recording heads for respective colors used in the recording. The recording unit 24 may be either of the line type or the serial type. The recording head included in the recording unit 24 is formed with a nozzle. From the nozzle formed in the recording head for each color, ink of the corresponding color is discharged to the base material conveyed by the conveying unit 22. In this way, in the recording unit 24, the predetermined colored pattern is recorded onto the conveyed base material. Other description regarding the inkjet recording apparatus 20 will be omitted.

The control apparatus 40 is, for example, an information processing apparatus such as a personal computer. As illustrated in FIG. 1, the control apparatus 40 has a control unit 42, a storage unit 44, an operating unit 46, a display unit 48, and a connection interface (hereafter, referred to as "connection I/F") 50. The control unit 42 executes various processes for controlling the inkjet recording apparatus 20. The control unit 42 includes a CPU 421, a memory 422, and so on. As the memory 422, a RAM or the like is exemplified. The storage unit 44 is a storage device such as a hard disk. In the storage unit 44, the computer program is installed and various data such as the color and pattern table, the image data, and the like are stored. As the computer program, a computer program for the decorating process described later is exemplified.

Figures 3, 4:
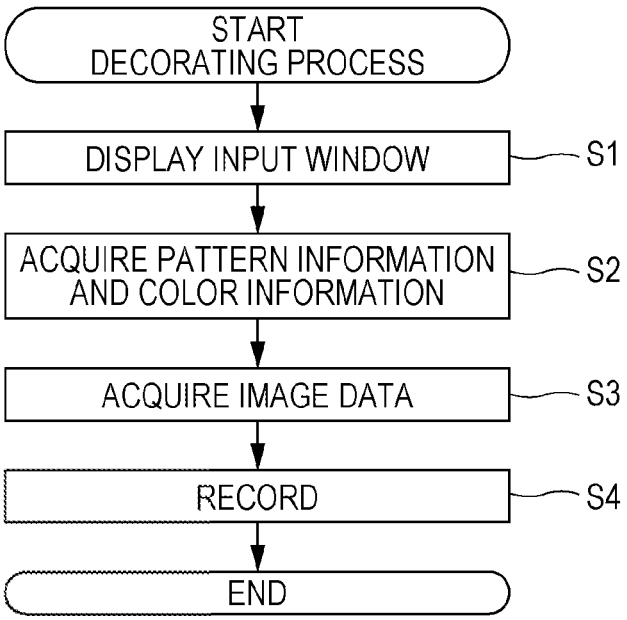
FIG. 3 is a diagram illustrating a color and pattern table.
FIG. 4 is a flowchart of a decorating process.

As illustrated in FIG. 3, the color and pattern table is a database that associates the pattern information, the color information, and the image data information. In the color and pattern table, the respective information corresponding to the sample lists is registered. The color and pattern table illustrated in FIG. 3 is in a state of corresponding to the first to third sample lists illustrated in FIG. 2. In the color and pattern table, No. "1" to No. "4" are the records in which the information corresponding to the first sample list is registered. No. "5" to No. "8" are the records in which the information corresponding to the second sample list is registered. No. "9" to No. "12" are the records in which the information corresponding to the third sample list is registered.

The pattern information is information for identifying the pattern to be recorded onto the base material to decorate the cloth. The pattern information "PPP" corresponds to "pattern P" illustrated in FIG. 2. The pattern information "QQQ" corresponds to "pattern Q" illustrated in FIG. 2. The pattern information "RRR" corresponds to "pattern R" illustrated in FIG. 2. The color information is information for identifying the color. The color information "BLK" represents black. The color information "RED" represents red. The color information "BLU" represents blue. The color information "YEL" represents yellow. The image data information is information for identifying the image data corresponding to the pattern information and the color information associated in each record. Specifically, the image data information is the information that combines the location where the image data is stored with the file name of the image data.

The operating unit 46 is an interface for inputting a predetermined instruction to the control apparatus 40. The operating unit 46 includes a keyboard and a mouse, for example. The operating unit 46 may include a touch panel function. The display unit 48 is a monitor such as an LCD. On the display unit 48, a predetermined window is displayed. For example, when a predetermined colored pattern is recorded onto the base material, an input window is displayed. The input window is a window configured to accept the input of the pattern information for identifying the pattern to be recorded and the color information for identifying the color. The connection I/F 50 connects the control apparatus 40 to the inkjet recording apparatus 20 via the communication cable 60. The connection I/F 50 communicates with the inkjet recording apparatus 20.

When the inkjet recording apparatus 20 is controlled by the control apparatus 40, the control unit 42 accesses the storage unit 44 to execute a predetermined computer program. More specific description will be provided by using an example of the case where the decorating method described later is performed in the decorating system 10. The CPU 421 included in the control unit 42 accesses the storage unit 44 and uses the memory 422 to execute the computer program for the decorating process. At this time, the CPU 421 accesses the color and pattern table. The CPU 421 specifies the image data information according to the pattern information and the color information and reads out the image data corresponding to the specified image data information from the storage unit 44 to the memory 422. The CPU 421 then executes the process for recording the image by the inkjet recording apparatus 20. In this way, the CPU 421 executes the predetermined computer program and thus various functions are implemented. That is, the control unit 42 configures a function unit for various operations performed by the inkjet recording apparatus 20.

<Decorating Method and Decorating Process>

The decorating method and the decorating process will be described by referring to FIG. 4. The decorating method is performed in the decorating system 10. The decorating method includes first step to third step for recording a predetermined colored pattern onto the base material set at the inkjet recording apparatus 20 to manufacture the cloth decorated with the predetermined colored pattern. The first step is a step for acquiring pattern information for identifying a pattern and color information for identifying a color with respect to the predetermined colored pattern to be recorded onto the base material. The second step is a step for acquiring the image data corresponding to the pattern information and the color information acquired at the first step, from the storage unit 44. The third step is a step for recording the colored pattern corresponding to the image data acquired at the second step onto the base material.

The decorating process is a process for performing the decorating method. Each step of the decorating method is implemented by that the computer program for the decorating process is executed by the control unit 42 (the CPU 421). The decorating process is started when a start instruction of this process is inputted to the control apparatus 40. In response, each step of the decorating method is performed in the decorating system 10. The operator operates the operating unit 46 to input the start instruction.

When the start instruction is inputted, the control unit 42 performs the control of displaying, on the display unit 48, the input window for accepting the input of the pattern information and the color information (S1). An instruction for causing the display unit 48 to display the input window is outputted from the control unit 42. The input window is displayed on the display unit 48. The operator operates the operating unit 46 to input the pattern information and the color information according to the request from the consumer. The operator then makes a finalizing operation through the operating unit 46. When finalizing operation is made, the control unit 42 acquires the inputted pattern information and color information (S2). The acquired pattern information and color information are stored in the memory 422 included in the control unit 42.

The control unit 42 then acquires the image data corresponding to the pattern information and the color information that have been acquired at the step S2 and stored in the memory 422 (S3). At the step S3, the control unit 42 accesses the color and pattern table stored in the storage unit 44. The control unit 42 specifies a record which associates and registers the pattern information and the color information matching the pattern information and the color information acquired at the step S2 and stored in the memory 422. For example, it is assumed that the pattern information at the step S2 is "PPP" and the color information at the step S2 is "BLK". In this case, the control unit 42 specifies the record of No. "1" in the color and pattern table illustrated in FIG. 3. Subsequently, the control unit 42 specifies the image data information registered in this record, and reads out from the storage unit 44, the image data corresponding to the specified image data information. The read-out image data is stored in the memory 422. That is, when the record of No. "1" is specified, the control unit 42 reads out "image_A" and stores this in the memory 422.

Next, the control unit 42 performs the control of recording, by the inkjet recording apparatus 20, the colored pattern corresponding to the image data acquired at the step S3 and stored in the memory 422 (S4). The control unit 42 inputs an execution instruction for the recording of the colored pattern corresponding to the image data to the inkjet recording apparatus 20 via the connection I/F 50. In the inkjet recording apparatus 20, the base material is conveyed by the conveying unit 22, and the colored pattern corresponding to the image data is recorded onto the base material passing by the recording unit 24. The operator sets the base material at the inkjet recording apparatus 20 at the timing before the start of the first step of the decorating method, for example. The base material to be set is a base material associated with the pattern corresponding to the pattern information inputted at the step S2 and is specified according to the association defined in the sample lists (see FIG. 2). In the implementation of the decorating system 10 of the present embodiment, the sample lists in which the associations are defined as illustrated in FIG. 2 are prepared in the form of a job order, for example. In this way, the cloth decorated with the colored pattern corresponding to the image data is manufactured in the decorating system 10.

In the above description, the step S2 of the decorating process is the process corresponding to the first step of the decorating method. By the execution of the step S2, the first step is performed in the decorating system 10. The step S3 of the decorating process is the process corresponding to the second step of the decorating method. By the execution of the step S3, the second step is performed in the decorating system 10. The step S4 of the decorating process is the process corresponding to the third step of the decorating method. By the execution of the step S3, the third step is performed in the decorating system 10.

<Advantages of the Present Embodiment>

The present embodiment allows for the following advantages. Specifically, in the above description, the predetermined colored pattern is recorded onto the base material by using the inkjet recording apparatus 20 to manufacture the decorated cloth. In the decorating system 10, the designs are fixed in a plurality of sets (see FIG. 2 and FIG. 3) by the combination of a plurality of patterns with a plurality of colors. Therefore, the cloth decorated with the predetermined colored pattern, which is to be the material for forming a predetermined cloth product, can be preferably manufactured by using an inkjet recording apparatus 20. As the conventional method for manufacturing the cloth formed with the predetermined colored pattern, there is a method of forming the pattern on a surface at a step of weaving the cloth by using the weaving machine or a step of knitting the cloth by using the knitting machine, for example. In such a conventional method, the weaving machine or the knitting machine has to be set to the configuration that corresponds to the colored pattern to be formed. When the colored pattern to be formed is changed, such an operation has to be done for each time. This operation may be complicated and difficult. In the method as disclosed in Patent Literature 1, it is necessary to apply the predetermined composition, subsequently apply a heat treatment, and finally apply a cleaning process. It is thus supposed that the conventional method requires long time for the preparation or the post-process.

By fixing the design into a plurality of sets, the decorating system 10 is able to smoothly perform the recording by the inkjet recording apparatus 20 in manufacturing the cloth. The image data corresponding to the colored pattern to be recorded onto the base material can be generated prior to the implementation of the decorating system 10, for example. Although description is omitted in the above, in order to record the predetermined colored pattern onto the base material at a high quality by the inkjet recording apparatus 20, it is necessary to examine various conditions for the recording such as the discharge amount of the ink. In examining the conditions, it is also necessary to take the type of the base material into consideration. Even when the colored pattern is the same, the different types of the base material may result in the different conditions. Therefore, according to the decorating system 10 and the decorating method (decorating process) of the present embodiment, when a cloth decorated with the predetermined colored pattern out of the plurality of fixed designs is requested by the consumer, the requested colored pattern can be promptly recorded onto the base material and the requested cloth can be manufactured and provided in a short time. According to the decorating method by the decorating system 10, it is considered that the smaller production lot of the decorated cloth often results in the greater cost benefit compared to the case of the above-described conventional method.

The inkjet recording apparatus 20 is able to achieve the high quality recording. This allows the user viewing the cloth to give the same impression as or similar impression to the case when viewing the colored pattern rendered by the woven cloth or the knitted cloth. In the decorating system 10, the predetermined colored pattern recorded onto the base material is expressed by the image data. The image data is readily specified by the pattern information and the color information acquired at the step S2 of the decorating process. The predetermined colored pattern to be targeted to record can be easily changed. Even when the request from the consumer is of a small lot or a medium lot, such situation can preferably be addressed.

The Applicant has developed and implemented the system called as Viscotecs™ disclosed in Non-patent Literature 1 as described above. This system is able to support various types and various forms of colored patterns (designs). For example, it can preferably address the manufacturing of a cloth that is to be a material of the custom-made dress, which is only one in the world. In this system, in order to support the various types and various forms of colored patterns, the image data corresponding to the colored pattern to be recorded onto the base material is generated according to the request from the consumer.

Under such circumstances, the Applicant has advanced the development of the technology for efficiently manufacturing the cloth decorated with various colored patterns without deteriorating the superiority of the system called as Viscotecs™ that has been successful. As a result, the Applicant has newly developed the decorating system 10, the control apparatus 40 included therein, and the decorating method performed in the decorating system 10. These two different systems make it possible to support from the manufacturing of the cloths of the extremely small production amount with a high added value (which are supported by the Viscotecs™ that has already been put into use) up to the manufacturing of the cloths of the small lot or the medium lot (which are supported by the decorating system 10 and so on).

<Modifications>

Configuration of the present embodiment can be modified as follows.

(1) The above description has exemplified the configuration in which the control apparatus 40 has the storage unit 44 and the image data is stored in the storage unit 44. Besides this, the image data may be stored in an external storage unit (hereafter, referred to as "storage device") that is able to communicate data with the control apparatus 40. In this case, decorating system 10 includes this storage device. The control apparatus 40 and this storage device are in a state where they are able to communicate data through a network such as a LAN. In the color and pattern table, the information for identifying the image data stored in the storage device, specifically, the location where the image data is stored (including the address of the storage device) and the file name of the image data are registered as the image data information. The control unit 42 acquires the image data from the storage device at the step S3 of the decorating process.

(2) The above description has exemplified the configuration in which the sample lists in which the associations as illustrated in FIG. 2 are defined is prepared in the form of the job order, for example, and, according to this, the operator sets the proper type of base material at the inkjet recording apparatus 20. The configuration for stocking a plurality of types of base materials may be provided to the inkjet recording apparatus 20 and the base material corresponding to the association defined in the sample list (see FIG. 2) may be automatically set at the inkjet recording apparatus 20. In this case, as the configuration for specifying the predetermined base material out of the plurality of types of base materials, the information for identifying the base material in each record is associated with the color and pattern table while corresponding to the sample lists. At the step S3, the image data and the base material registered in the specified record are specified. The control unit 42 performs a control of setting the specified base material at the inkjet recording apparatus 20.

Besides this, the decorating system 10 may include a plurality of inkjet recording apparatus 20 at which a plurality of types of base materials are set, respectively, and, at the step S4 of the decorating process, the control unit 42 may input the recording execution instruction to the inkjet recording apparatus 20 at which the corresponding type of the base material has been set. Also in this case, the information for identifying the base material is registered in the color and pattern table similarly to the above. Furthermore, in the color and pattern table, registered for each record is the information for identifying the inkjet recording apparatus 20 at which the base material corresponding to the information for identifying the base material registered in the record has been set. The association of the base material with the inkjet recording apparatus 20 may be defined by providing another table different from the color and pattern table. At the step S4 of the decorating process, specified is the inkjet recording apparatus 20 which is associated with the information for identifying the base material registered in the record that has been specified at the step S3.

DESCRIPTION OF REFERENCE SIGNS

10 Decorating system
20 Inkjet recording apparatus
22 Conveying unit
24 Recording unit
40 Control apparatus
42 Control unit
44 Storage unit
46 Operating unit
48 Display unit
50 Connection interface (connection I/F)
60 Communication cable
421 CPU
422 Memory

The invention claimed is:

1. A decorating method for recording a predetermined colored pattern onto a base material set at an inkjet recording apparatus to manufacture a cloth decorated with the predetermined colored pattern, the decorating method comprising:

acquiring one of first pattern information for identifying a first pattern and second pattern information for identifying a second pattern and one of first color information for identifying a first color and second color information for identifying a second color;

specifying one of first to fourth records included in a color and pattern table stored in a storage unit, the first record comprising the first pattern information, the first color information and first image data information for identifying first image data comprising the first pattern and the first color, the second record comprising the first pattern information, the second color information and second image data information for identifying second image data comprising the first pattern and the second color, the third record comprising the second pattern information, the first color information and third image data information for identifying third image data comprising the second pattern and the first color, and the fourth record comprising the second pattern information, the second color information and fourth image data information for identifying fourth image data comprising the second pattern and the second color, such that the acquired pattern information and the acquired color information match the pattern information and the color information in the one of the first to fourth records, the first to fourth image data being stored in the storage unit;

acquiring one of the first to fourth image data identified by the image data information in the specified record, from the storage unit; and recording, onto the base material, the acquired image data identified by the image data information in the specified record.

2. The decorating method according to claim 1, wherein the first image data and the second image data are associated with a first base material, wherein the third image data and the fourth image data are associated with a second base material, and wherein when the first record specified, the first image data identified by the first image data information is recorded onto the first base material, when the second record is specified, the second image data identified by the second image data information is recorded onto the first base material, when the third record is specified, the third image data identified by the third image data information is recorded onto the second base material, and when the fourth record is specified, the fourth image data identified by the fourth image data information is recorded onto the second base material.

3. The decorating method according to claim 2, wherein the second base material is different from the first base material.

4. The decorating method according to claim 1, wherein, in the color and pattern table, the first image data and the second image data are associated with a first base material and the third image data and the fourth image data are associated with a second base material, wherein, when the first record is specified, the first base material is set at the inkjet recording apparatus based on the color and pattern table, and the first image data identified by the first image data information is recorded onto the first base material, when the second record is specified, the first base material is set at the inkjet recording apparatus based on the color and pattern table, and the second image data identified by the second image data information is recorded onto the first base material, when the third record is specified, the second base material is set at the inkjet recording apparatus based on the color and pattern table, and the third image data identified by the third image data information is recorded onto the second base material, and when the fourth record is specified, the second base material is set at the inkjet recording apparatus based on the color and pattern table, and the fourth image data identified by the fourth image data information is recorded onto the second base material.

5. The decorating method according to claim 4, wherein the second base material is different from the first base material.

6. The decorating method according to claim 1, wherein at least two of the first to fourth image data are stored in the storage unit before acquiring the one of first and second pattern information and the one of first and second color information.

7. The decorating method according to claim 1, further comprising:

providing a sample list comprising a first sample with the first pattern and the first color, a second sample with the first pattern and the second color, a third sample with the second pattern and the first color and a fourth sample with the second pattern and the second color before the acquiring one of first and second pattern information and one of first and second color information.

8. A control apparatus that, when manufacturing a cloth decorated with a predetermined colored pattern, controls an inkjet recording apparatus configured to record the predetermined colored pattern onto a base material, the control apparatus comprising a processor configured to:

acquire one of first pattern information for identifying a first pattern and second pattern information for identifying a second pattern and one of first color information for identifying a first color and second color information for identifying a second color, the one of first and second pattern information and the one of first and second color information being inputted to the control apparatus;

specify one of first to fourth records included in a color and pattern table stored in a storage unit, the first record comprising the first pattern information, the first color information and first image data information for identifying first image data comprising the first pattern and the first color, the second record comprising the first pattern information, the second color information and second image data information for identifying second image data comprising the first pattern and the second color, the third record comprising the second pattern information, the first color information and third image data information for identifying third image data comprising the second pattern and the first color, and the fourth record comprising the second pattern information, the second color information and fourth image data information for identifying fourth image data comprising the second pattern and the second color, such that the acquired pattern information and the acquired color information match the pattern information and the color information in the one of the first to fourth records, the first to fourth image data being stored in the storage unit acquire one of the first to fourth image data identified by the image data information in the specified record, from the storage unit; and perform a control of recording, by the inkjet recording apparatus, onto the base material, the acquired image data identified by the image data information in the specified record.

9. The control apparatus according to claim 8, wherein in the color and pattern table, the first image data and the second image data are associated with a first base material and the third image data and the fourth image data are associated with a second base material, when the first record is specified, the control apparatus controls the inkjet recording apparatus to have the first base material based on the color and pattern table and record the first image data identified by the first image data information onto the first base material, when the second record is specified, the control apparatus controls the inkjet recording apparatus to have the first base material based on the color and pattern table and record the second image data identified by the second image data information onto the first base material, when the third record is specified, the control apparatus controls the inkjet recording apparatus to have the second base material based on the color and pattern table and record the third image data identified by the third image data information onto the second base material, and when the fourth record is specified, the control apparatus controls the inkjet recording apparatus to have the second base material based on the color and pattern table and record the fourth image data identified by the fourth image data information onto the second base material.

10. The control apparatus according to claim 9, wherein the second base material is different from the first base material.

11. The control apparatus according to claim 8, wherein at least two of the first to fourth image data are stored in the storage unit before the processor acquires the one of first and second pattern information and the one of first and second color information.

12. A decorating system that manufactures a cloth decorated with a predetermined colored pattern, the decorating system comprising:

an inkjet recording apparatus configured to record the predetermined colored pattern onto a base material;

a control apparatus configured to control the inkjet recording apparatus; and a storage unit configured to store a plurality of image data and a color and pattern table, the plurality of image data comprising first image data comprising a first pattern and a first color, second image data comprising first pattern and a second color, third image data comprising a second pattern and the first color, and fourth image data comprising the second pattern and the second color, the color and pattern table comprising a first record comprising first pattern information for identifying the first pattern, first color information for identifying the first color and first image data information for identifying the first image data, a second record comprising the first pattern information, second color information for identifying the second color and second image data information for identifying the second image data, a third record comprising second pattern information for identifying the second pattern, the first color information and third image data information for identifying the third image data, and a fourth record comprising the second pattern information, the second color information and fourth image data information for identifying the fourth image data, wherein the control apparatus includes a processor configured to:

acquire one of the first and second pattern information and one of the first and second color information inputted to the control apparatus;

specifying one of the first to fourth records included in the color and pattern table stored in the storage unit such that the acquired pattern information and the acquired color information match the pattern information and the color information in the one of the first to fourth records;

acquire one of the first to fourth image data identified by the image data information in the specified record, from the storage unit; and perform a control of recording, by the inkjet recording apparatus, onto the base material, the acquired image data identified by the image data information in the specified record.

13. The decorating system according to claim 12, wherein in the color and pattern table, the first image data and the second image data are associated with a first base material and the third image data and the fourth image data are associated with a second base material, when the first record is specified, the control apparatus controls the inkjet recording apparatus to have the first base material based on the color and pattern table and record the first image data identified by the first image data information onto the first base material, when the second record is specified, the control apparatus controls the inkjet recording apparatus to have the first base material based on the color and pattern table and record the second image data identified by the second image data information onto the first base material, when the third record is specified, the control apparatus controls the inkjet recording apparatus to have the second base material based on the color and pattern table and record the third image data identified by the third image data information onto the second base material, and when the fourth record is specified, the control apparatus controls the inkjet recording apparatus to have the second base material based on the color and pattern table and record the fourth image data identified by the fourth image data information onto the second base material.

14. The decorating system according to claim 13, wherein the system comprises a plurality of the inkjet recording apparatuses at which a plurality of types of base materials are set, respectively, the color and pattern table further comprises information of the types of the base materials of the respective inkjet recording apparatuses, and the processor is further configured to select an inkjet recording apparatus based on the acquired image data and the information of the types of the base materials of the respective inkjet recording apparatuses in the color and pattern table.

15. The decorating system according to claim 12, wherein at least two of the first to fourth image data are stored in the storage unit before the processor acquires the one of first and second pattern information and the one of first and second color information.

* * * * *